US008662904B2

(12) United States Patent
Tuan

(10) Patent No.: US 8,662,904 B2
(45) Date of Patent: Mar. 4, 2014

(54) ELECTRICAL POWER CONNECTOR HAVING A HOUSING WITH STEPPED STOP PORTIONS, PARTITION PLATES AND HOOKS FOR ENGAGING OPENINGS IN THE TERMINALS

(75) Inventor: Hao-Jan Tuan, Taoyuan County (TW)

(73) Assignee: Aces Electronics Co., Ltd., Jhongli, Taoyuan County (TW)

( * ) Notice: Subject to any disclaimer, the term of this patent is extended or adjusted under 35 U.S.C. 154(b) by 39 days.

(21) Appl. No.: 13/568,934

(22) Filed: Aug. 7, 2012

(65) Prior Publication Data

US 2013/0109241 A1 May 2, 2013

(30) Foreign Application Priority Data

Oct. 28, 2011 (TW) ..... 100220375 U

(51) Int. Cl.
*H01R 12/00* (2006.01)

(52) U.S. Cl.
USPC ..... 439/79

(58) Field of Classification Search
USPC ..... 439/79, 595, 637, 59, 638
See application file for complete search history.

(56) References Cited

U.S. PATENT DOCUMENTS

| | | | | |
|---|---|---|---|---|
| 7,828,560 | B2 * | 11/2010 | Wu et al. | 439/79 |
| 7,914,302 | B1 * | 3/2011 | Zhu | 439/79 |
| 8,092,235 | B2 * | 1/2012 | Frantum et al. | 439/79 |
| 8,282,402 | B2 * | 10/2012 | Ngo | 439/79 |

* cited by examiner

*Primary Examiner* — Chandrika Prasad
(74) *Attorney, Agent, or Firm* — Muncy, Geissler, Olds & Lowe, PLLC

(57) ABSTRACT

An electrical power connector includes an electrically insulative housing defining multiple front mating portions, multiple rear partition plates, an accommodation chamber between each two adjacent partition plates corresponding to one respective mating portion, a mating chamber in each mating portion, stepped stop portions in top and bottom sides in each mating chamber and springy hooks suspending in top and bottom sides in each accommodation chamber, and pairs of conducting terminals mounted in the accommodation chambers and having respective front mating end portions suspending in the mating chambers with respective openings and stop rods thereof respectively forced into engagement with the springy hooks and stepped stop portions of the electrically insulative housing.

6 Claims, 8 Drawing Sheets

ELECTRICAL POWER CONNECTOR HAVING A HOUSING WITH STEPPED STOP PORTIONS, PARTITION PLATES AND HOOKS FOR ENGAGING OPENINGS IN THE TERMINALS

This application claims the priority benefit of Taiwan patent application number 100220375, filed on Oct. 28, 2011.

BACKGROUND OF THE INVENTION

1. Field of the Invention

The present invention relates to electrical connector technology and more particularly, to an electrical power connector, which has a smart structural design, facilitating assembling and enhancing component positioning stability.

2. Description of the Related Art

When designing an electrical connector, a designer normally will pay attention to two basic parts, i.e., signal and power supply. When designing a signal circuit, a designer normally will not consider the factor of current variation for the reason that the applied current is normally low. However, with respect to the transmission of signals, a designer may consider the nature of the carrier (high frequency, low frequency) and many other factors (static interference, magnetic interference, impedance matching, etc.) without taking the factor of temperature into account. With respect to power supply, conducting a high-current power supply through a power circuit will increase the impedance, causing a rise in temperature. Thus, when designing an electrical power connector, the factors of quick heat dissipation and low conducting terminal impedance must be considered, avoiding a significant change in the electrical characteristics. Further, an electrical connector of this kind is adapted for conducting power supply, its terminal contact surface area and the related heat dissipation arrangement will affect power transmission quality. An electrical power connector may be used in a power adapter or server and connected to a connection portion of a circuit board. When conducting a high current to cause a rise in impedance, heat will be produced, affecting system performance and operating safety.

Further, an electrical power connector may be used in a power adapter or server and connected to a circuit board for conducting power supply. According to conventional electrical power connector designs, the power conducting metal terminals commonly have barbed portions for positioning in the electrically insulative plastic housing. However, if the electrically insulative plastic housing is excessively compressed, it may be damaged or a ridged surface may occur. In this case, the retaining force provided by the electrically insulative plastic housing to secure the power conducting metal terminals will be lowered, and the barbed portions may be forced out of place easily when the electrically insulative plastic housing is compressed again. Therefore, structural stability of an electrical power connector is very important. Improving the structural stability of electrical power connectors is the subject people engaging in this field must taken into account.

SUMMARY OF THE INVENTION

The present invention has been accomplished under the circumstances in view. It is therefore the main object of the present invention to provide an electrical power connector, which facilitates assembling and enhances component positioning stability.

To achieve this and other objects of the present invention, an electrical power connector comprises an electrically insulative housing, pairs of conducting terminals mounted in the electrically insulative housing. The electrically insulative housing comprises a plurality of mating portions arranged at the front side, a plurality of partition plates disposed at the rear side, an accommodation chamber defined between each two adjacent partition plates corresponding to one respective mating portion, a mating chamber defined in each mating portion, two stepped stop portions respectively disposed in opposing top and bottom sides inside each mating chamber, and a plurality of springy hooks respectively extended from opposing top and bottom sides thereof and respectively suspending in top and bottom sides in each accommodation chamber. The conducting terminals are arranged in pairs and respectively mounted in the accommodation chambers of the electrically insulative housing. Each conducting terminal comprises a panel base, a front mating end portion forwardly extended from the panel base and suspending in the front opening of one respective mating chamber, at least one opening cut through opposing top and bottom sides of the panel base and engaged with one respective springy hook, and a rear bonding end portion backwardly downwardly extended from said panel base.

Further, each conducting terminal comprises two stop rods forwardly extended from the panel base thereof and suspending at two opposite lateral sides relative to the front mating end portion thereof and stopped against one respective stepped stop portion of the electrically insulative housing to enhance positioning stability of the respective conducting terminal in the respective accommodation chamber of the electrically insulative housing.

DETAILED DESCRIPTION OF THE PREFERRED EMBODIMENT

Figure 1:
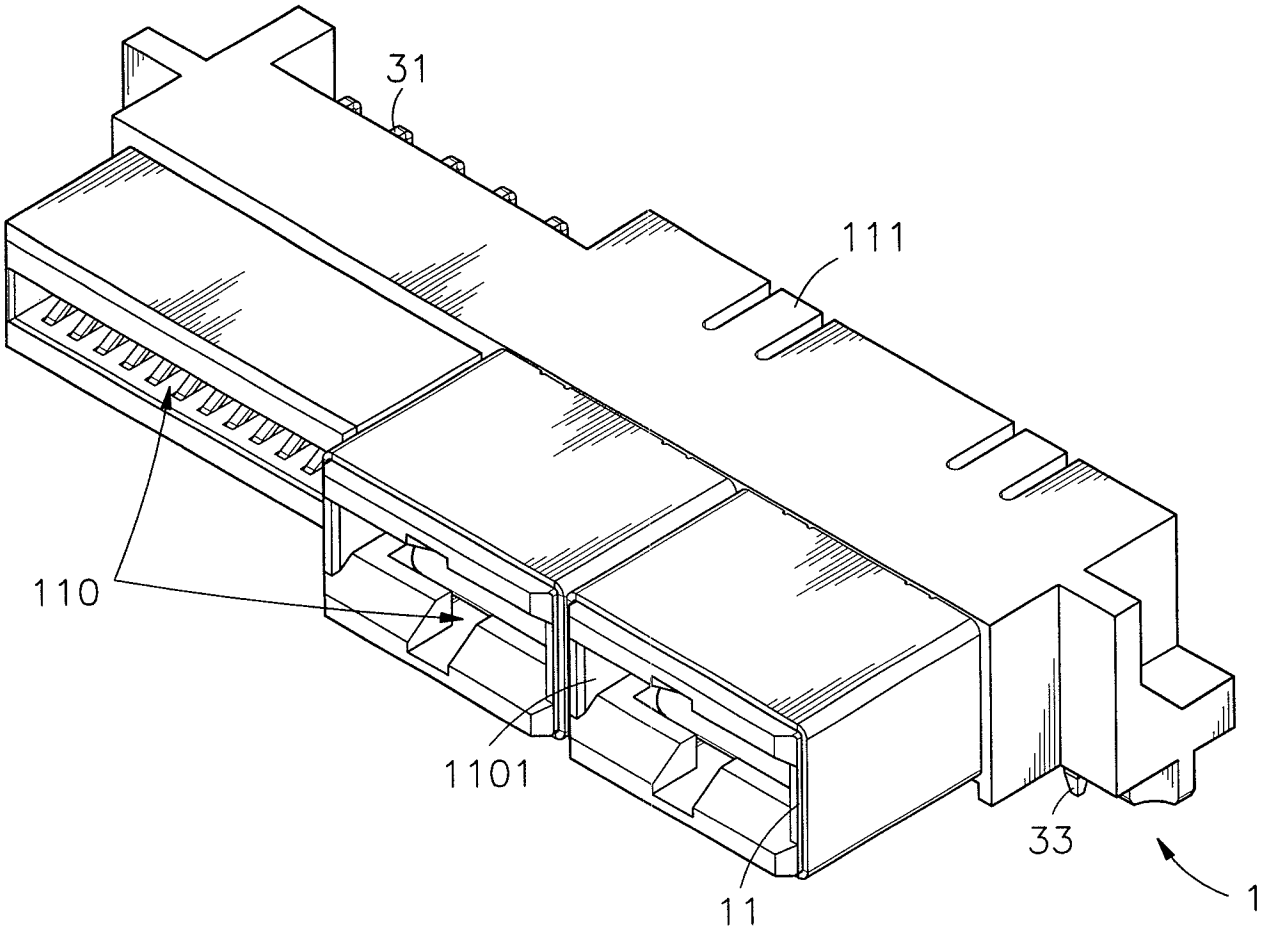
FIG. 1 is an elevational view of an electrical power connector in accordance with the present invention.
Figure 2:
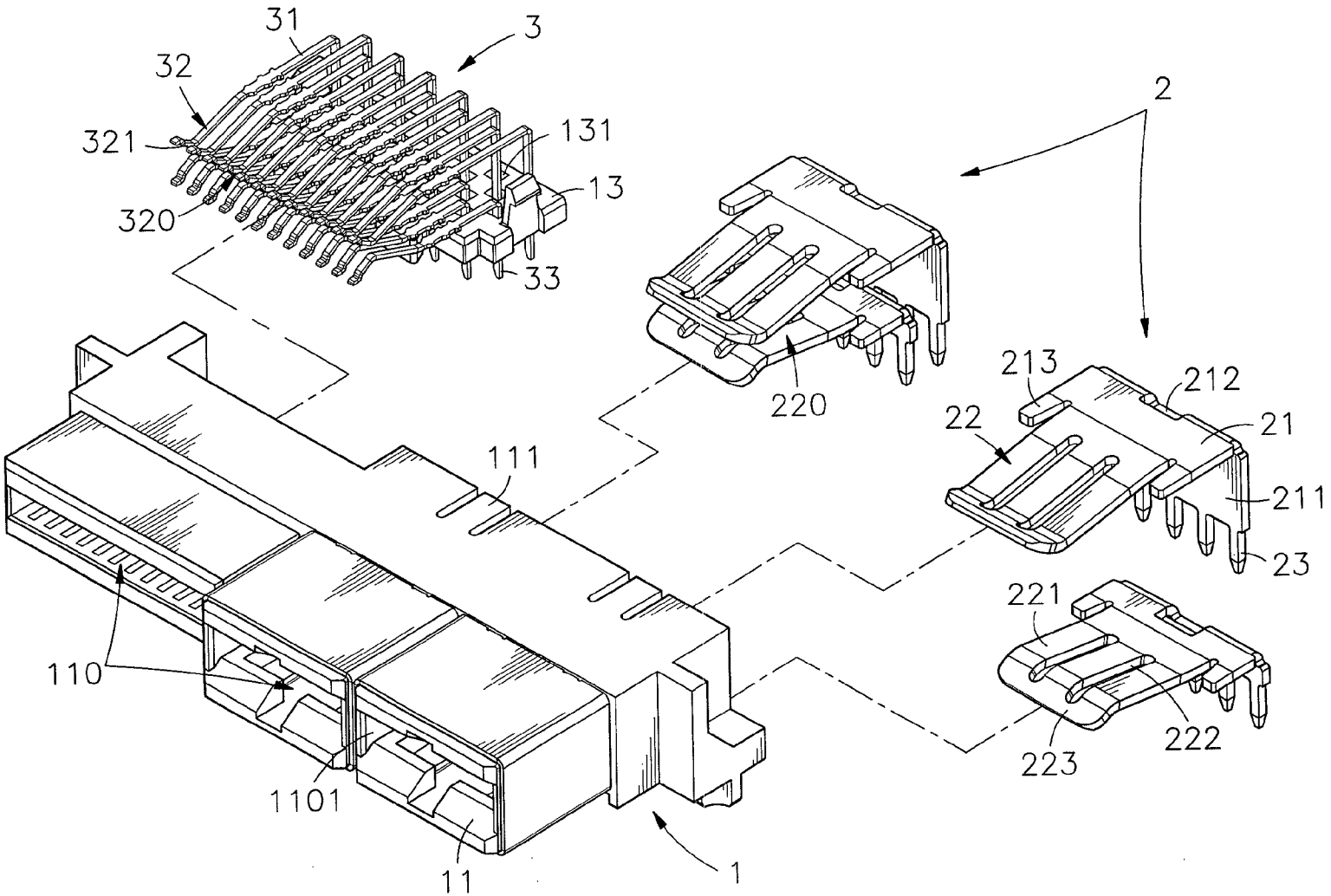
FIG. 2 is an exploded view of the electrical power connector in accordance with the present invention.
Figure 3:
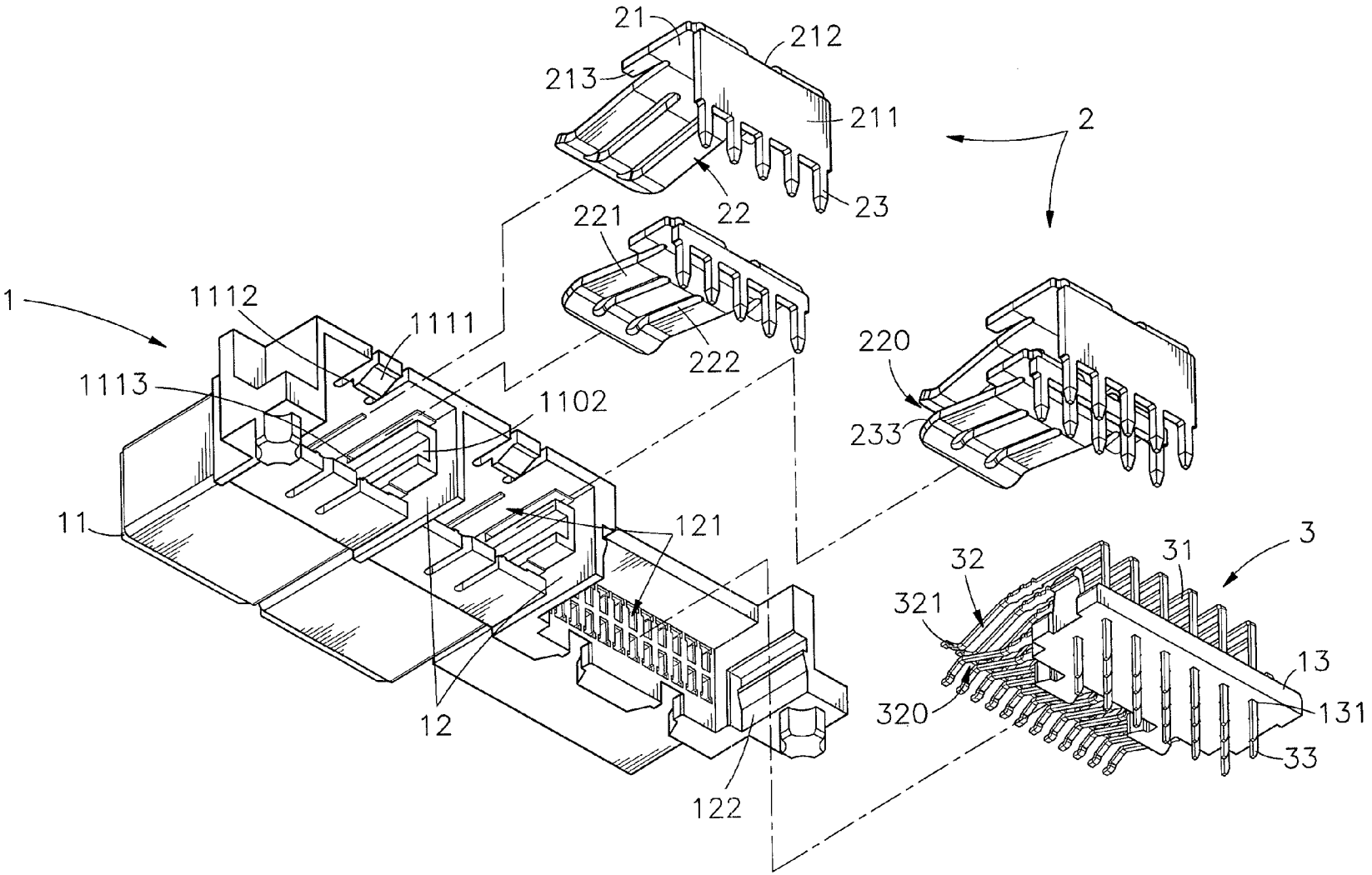
FIG. 3 corresponds to FIG. 2 when viewed from another angle.

Referring to FIGS. 1, 2 and 3, an electrical power connector in accordance with the present invention is shown. The electrical power connector comprises an electrically insulative housing 1, and a plurality of conducting terminals 2.

The electrically insulative housing 1 comprises a plurality of mating portions 11 arranged in parallel at a front side thereof, a plurality of partition plates 12 disposed at a rear side thereof, an accommodation chamber 121 defined between each two adjacent partition plates 12 corresponding to one respective mating portion 11, a mating chamber 110 defined in each mating portion 11 and defining a front opening 1101 in communication with one respective accommodation chamber 121, two guide grooves 1102 bilaterally disposed in each mating chamber 110 between the associating front opening 1101 and accommodation chamber 121, two stepped stop portions 1113 respectively disposed in opposing top and bottom sides inside the associating mating chamber 110, and a plurality of springy hooks 111 extended from opposing top and bottom sides thereof and respectively suspending in top and bottom sides in each accommodation chamber 121. Further, each springy hook 111 defines a bevel face 1111 located on a distal end thereof, and a vertical stop edge 1112 disposed at a back side of the bevel face 1111.

The conducting terminals 2 are arranged in pairs and respectively mounted in the accommodation chambers 121 of the electrically insulative housing 1. Each of the two vertically arranged conducting terminals 2 of each pair of conducting terminals in each accommodation chamber 121 comprises a panel base 21 having a vertically downwardly extending rear connection portion 211, an opening 212 cut through opposing top and bottom sides of the rear connection portion 211 of the panel base 21, a front mating end portion 22 forwardly extended from the panel base 21 and suspending in the front opening 1101 of the corresponding accommodation chamber 121, two stop rods 213 forwardly extended from the panel base 21 and suspending at two opposite lateral sides relative to the front mating end portion 22, and a rear bonding end portion 23 downwardly extended from the rear connection portion 211 of the panel base 21. Further, a retaining gap 220 is defined between the two vertically arranged conducting terminals 2 in each accommodation chamber 121 of the electrically insulative housing 1. Further, the front mating end portion 22 of each conducting terminal 2 defines a turning face 221, at least one, for example, two longitudinal slots 222 cut through opposing top and bottom sides of the turning face 221, and a front guide slope 223 obliquely downwardly (or obliquely upwardly) extended from the turning face 221.

According to this embodiment, the electrically insulative housing 1 comprises three mating portions 11, one configured subject to a first configuration design, and the other two configured subject to a second configuration design. The mating portion 11 configured subject to the first configuration design comprises a bottom opening 122 at the bottom side of the accommodation chamber 121, and a terminal block 13 mounted in the bottom opening 122. The terminal block 13 holds two vertically spaced sets of signal terminals 3. Each signal terminal 3 comprises a base portion 31, a front contact portion 32 forwardly extended from the base portion 31 and terminating in a spring arm 321 in the front opening 1101 of the respective accommodation chamber 121, and a rear bonding portion 33 backwardly extended from the base portion 31 and downwardly inserted through one respective terminal hole 131 of the terminal block 13. Further, a retaining gap 320 is defined between the front contact portions 32 of the two vertically spaced sets of signal terminals 3.

As stated above, the electrically insulative housing 1 comprises three mating portions 11, one configured subject to the first configuration design, and the other two configured subject to the second configuration design, wherein the mating portion 11 configured subject to the first configuration design is adapted for accommodating signal terminals 3, and the other two mating portions 11 configured subject to the second configuration design are adapted for accommodating the conducting terminals 2. Although the number and shape between the signal terminals 3 and the conducting terminals 2 are different, the mounting arrangement of the signal terminals 3 is substantially similar to that of the conducting terminals 2.

Figure 4:
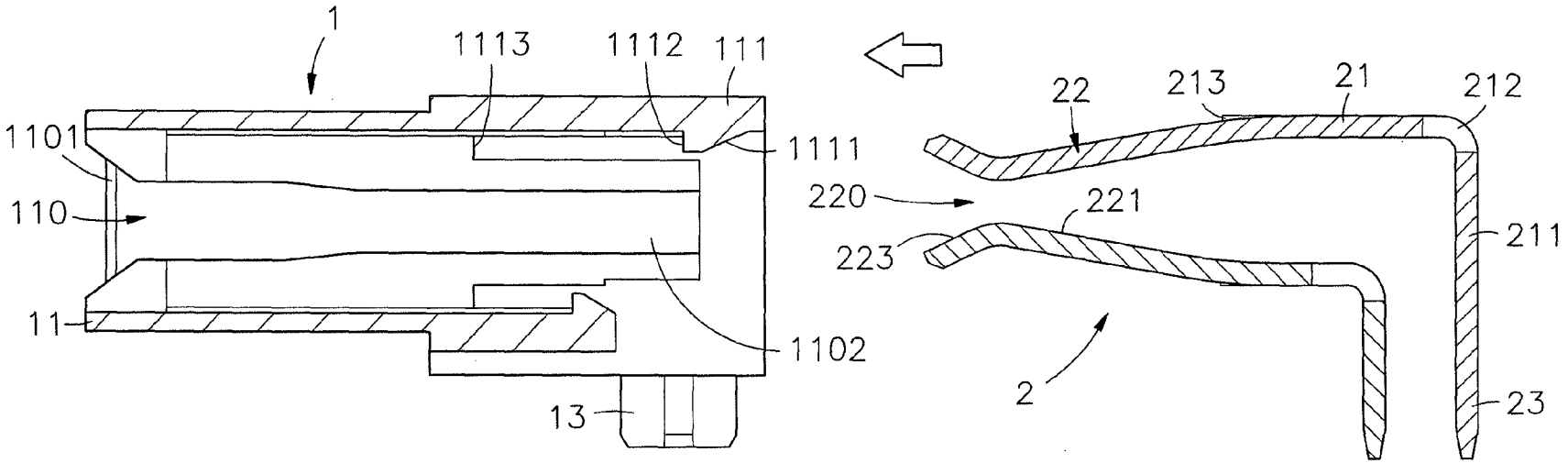
FIG. 4 is a schematic sectional side view illustrating the relationship between the electrically insulative housing and conducting terminals of the electrical power connector in accordance with the present invention before assembly.
Figure 5:
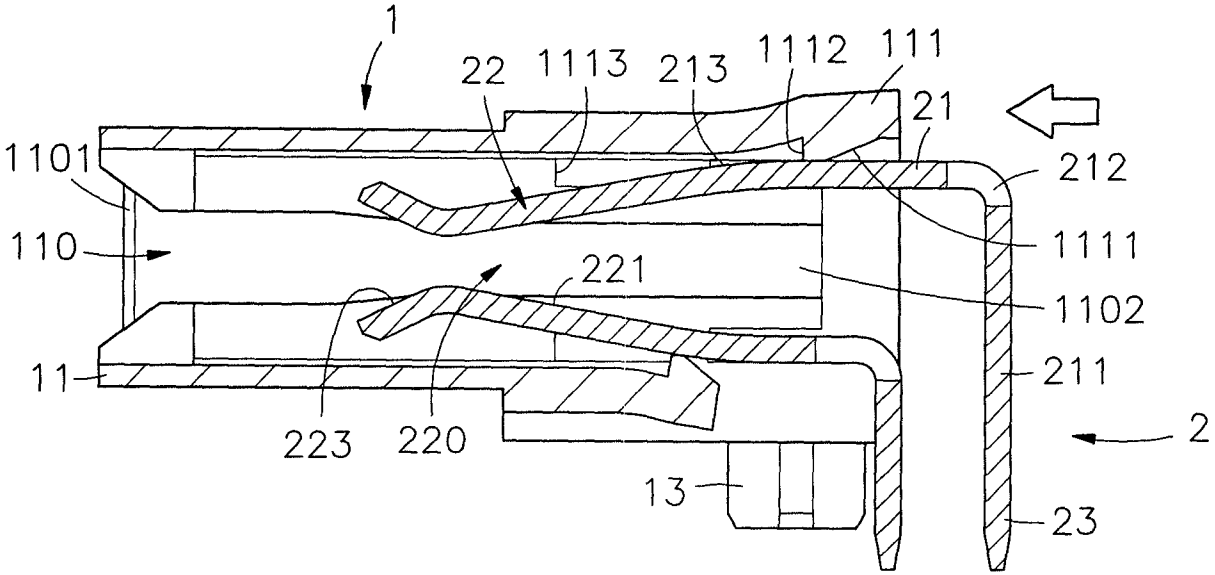
FIG. 5 corresponds to FIG. 4, illustrating the conducting terminals partially inserted into the electrically insulative housing.
Figure 6:
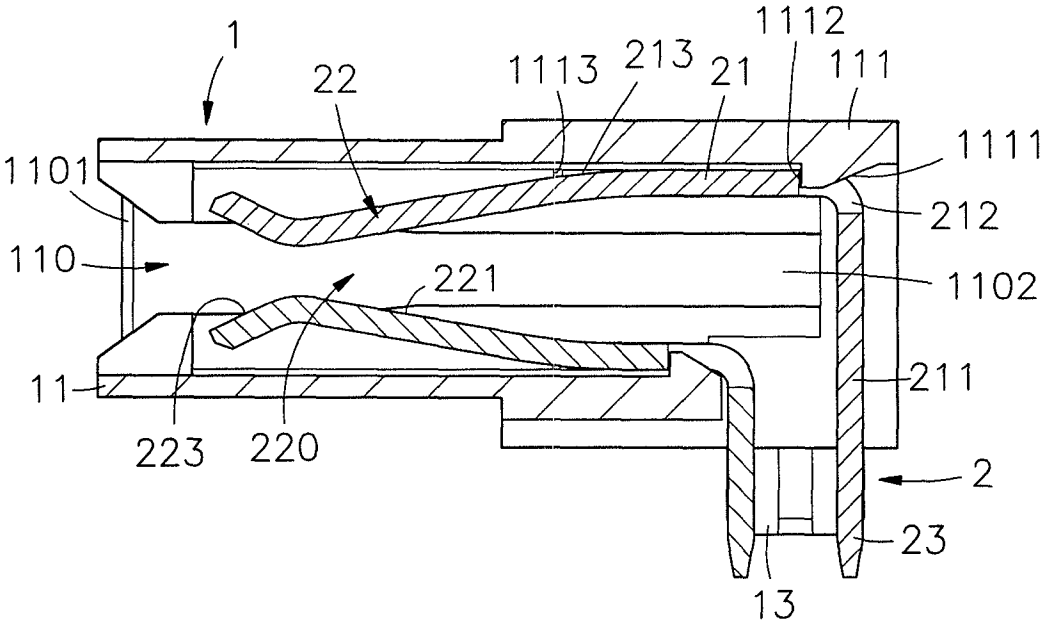
FIG. 6 corresponds to FIG. 5, illustrating the conducting terminals positively positioned in the electrically insulative housing.

Referring to FIGS. 4-6, when assembling the electrical power connector, insert the front mating end portions 22 of each pair of conducting terminals 2 into each respective accommodation chamber 121 between each two respective partition plates 12 of the electrically insulative housing 1 against the bevel faces 1111 of the respective two springy hooks 111. At this time, the respective springy hooks 111 are elastically deformed for allowing the front mating end portions 22 of the respective pair of conducting terminals 2 to pass. When the front mating end portions 22 of each pair of conducting terminals 2 are set in position in the accommodation chamber 121, the stop rods 213 of the respective conducting terminals 2 are abutted against the respective stepped stop portions 1113 of the electrically insulative housing 1, and the respective springy hooks 111 are immediately return to their former shape to engage the vertical stop edges 1112 thereof into the openings 212 of the respective conducting terminals 2, and therefore the respective conducting terminals 2 are locked to the electrically insulative housing 1 by the respective springy hooks 111. Thus, after insertion of the respective pairs of conducting terminals 2 into respective accommodation chambers 121 of the electrically insulative housing 1, the openings 212 of the respective conducting terminals 2 are respectively forced into engagement with the vertical stop edges 1112 of the respective springy hooks 111, and the stop rods 213 of the respective conducting terminals 2 are respectively forced into engagement with the respective stepped stop portions 1113 of the electrically insulative housing 1, and therefore the conducting terminals 2 are prohibited from forward and backward displacement relative to the electrically insulative housing 1.

Figure 7:
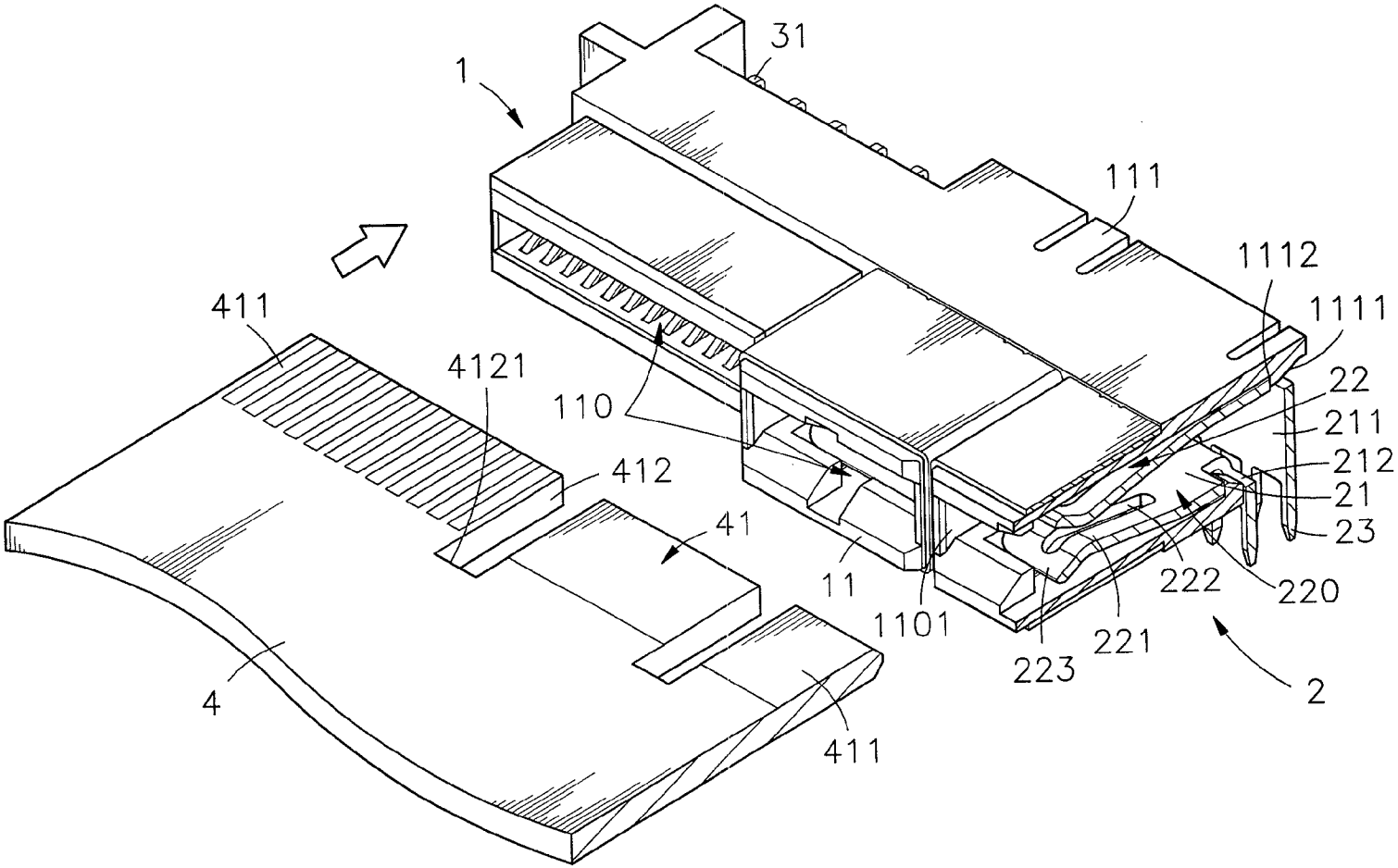
FIG. 7 is a schematic sectional elevation illustrating the relationship between the mating portions of the electrically insulative housing of the electrical power connector and the connection portions of a mating circuit board in accordance with the present invention.
Figure 8:
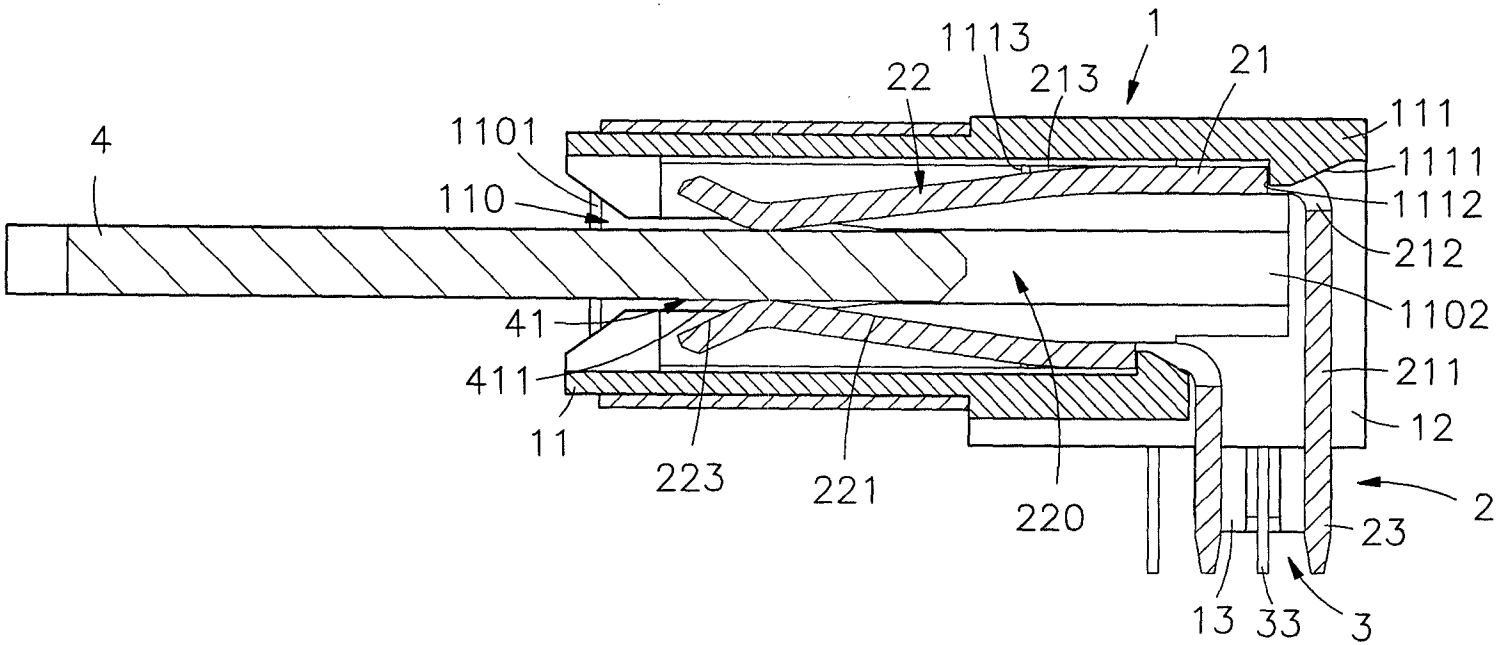
FIG. 8 is a sectional side view of the present invention, illustrating the respective connection portions of the mating circuit board inserted into the mating portions of the electrically insulative housing and kept in contact with the respective conducting terminals.

Referring to FIGS. 7 and 8, the electrical power connector is installed in a circuit board 4. The circuit board 4 comprises a plurality of connection portions 41 corresponding to the mating portions 11 of the electrical power connector, a front notch 412 defined between each two adjacent connection portions 41, a stop edge 4121 defined in each front notch 412, and a plurality of electric contacts 411 located on the opposing top and bottom sides of the connection portions 41.

During installation, the connection portions 41 of the circuit board 4 are respectively inserted through the front openings 1101 of the mating chambers 110 of the mating portions 11 of the electrically insulative housing 1 into the respective guide grooves 1102 in the respective mating chambers 110 and the retaining gaps 220 between the front mating end portions 22 of the respective pairs of vertically arranged conducting terminals 2 or the retaining gap 320 between the front contact portions 32 of the two vertically spaced sets of signal terminals 3. When set in position, the stop edges 4121 in the front notches 412 of the connection portions 41 of the circuit board 4 are respectively stopped against the front side of the mating portions 11 of the electrically insulative housing 1, and the turning faces 221 of the front mating end portions 22 of the conducting terminals 2 and the spring arm 321 of the front contact portions 32 of the signal terminals 3 of the terminal block 13 are respectively kept in contact with the respective electric contacts 411 at the connection portions 41 of the circuit board 4 positively. At this time, the connection portions 41 of the circuit board 4 can be positively inserted into the respective guide grooves 1102 and guided by the respective guide grooves 1102 into position accurately and positively. Subject to the structural design of the guide grooves 1102, the front mating end portions 22 of the conducting terminals 2 bear the pressure evenly and are kept in positive contact with a wide surface area of the respective electric contacts 411 at the connection portions 41 of the circuit board 4 for the transmission of high currents, and therefore less impedance and temperature will be produced during transmission of high currents through the electrical power connector. Thus, a high level of reproducibility and reliability of the electrical power connector at the end of the circuit board can be obtained, assuring a high level of power transmission efficiency and safety. Further, the circuit board 4 has a simple structure suitable for mass production to reduce the cost.

During transmission of a high current after installation of the electrical power connector in the circuit board 4, heat generated by the conducting terminals 2 can be dissipated into the atmosphere through the gaps between the vertically arranged conducting terminals 2 in the accommodation chambers 121. Further, the thickness of the circuit board 4 is much smaller than the height of the mating chambers 110 of the mating portions 11 of the electrically insulative housing 1. After insertion of respective connection portions 41 of the circuit board 4 into the mating chambers 110 of the mating portions 11 of the electrically insulative housing 1, currents of air caused by an electric fan can be guided through the mating chambers 110 of the mating portions 11 of the electrically insulative housing 1 to lower the temperature of the conducting terminals 2.

Referring to FIGS. 2, 3, 4 and 6 again, subject to the structural design of the springy hooks 111 of the electrically insulative housing 1 and the conducting terminals 2, the openings 212 and stop rods 213 of the conducting terminals 2 can be respectively formed into engagement with the vertical stop edges 1112 and stepped stop portions 1113 of the electrically insulative housing 1 after insertion of the conducting terminals 2 into the accommodation chambers 121 of the electrically insulative housing 1, and therefore the conducting terminals 2 are prohibited from forward and backward displacement relative to the electrically insulative housing 1 after installation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical power connector, comprising:

an electrically insulative housing comprising a plurality of mating portions arranged in parallel at a front side thereof, a plurality of partition plates disposed at a rear side thereof, an accommodation chamber defined between each two adjacent said partition plates corresponding to one respective said mating portion, a mating chamber defined in each said mating portion, said mating chamber defining a front opening, two stepped stop portions respectively disposed in opposing top and bottom sides inside each said mating chamber, and a plurality of springy hooks respectively extended from opposing top and bottom sides thereof and respectively suspending in top and bottom sides in each said accommodation chamber; and a plurality of conducting terminals arranged in pairs and respectively mounted in said accommodation chambers of said electrically insulative housing, each said conducting terminal comprising a panel base, a front mating end portion forwardly extended from said panel base and suspending in the front opening of one said mating chamber, at least one opening cut through opposing top and bottom sides of said panel base and engaged with one respective said springy hook, and a rear bonding end portion backwardly downwardly extended from said panel base.

2. The electrical power connector as claimed in claim 1, wherein each said springy hook comprises a bevel face located on a distal end thereof, and a vertical stop edge disposed at a back side of said bevel face and engaged into one said opening of said panel base of one said conducting terminal.

3. The electrical power connector as claimed in claim 1, wherein the front mating end portion of each said conducting terminal comprises a turning face, at least one longitudinal slot cut through opposing top and bottom sides of said turning face, and a front guide slope obliquely outwardly extended from said turning face.

4. The electrical power connector as claimed in claim 1, wherein the two conducting terminals of each pair of said conducting terminals are arranged at different elevations so that a retaining gap is defined between the two conducting terminals of one pair of said conducting terminals in each said accommodation chamber of said electrically insulative housing for receiving a mating connection portion of an external circuit board.

5. The electrical power connector as claimed in claim 1, wherein the panel base of each said conducting terminal comprises a vertically downwardly extending rear connection portion connected to the rear bonding end portion of the respective conducting terminal; the at least one opening of each said conducting terminal is located on the vertically downwardly extending rear connection portion of the panel base of the respective conducting terminal.

6. The electrical power connector as claimed in claim 1, wherein each said conducting terminal further comprises two stop rods forwardly extended from the panel base thereof and suspending at two opposite lateral sides relative to the front mating end portion thereof and stopped against one said stepped stop portion of said electrically insulative housing.

* * * * *